US010214391B2

(12) United States Patent
Wang et al.

(10) Patent No.: US 10,214,391 B2
(45) Date of Patent: Feb. 26, 2019

(54) SYSTEM AND METHOD FOR MONITORING HANDRAIL ENTRANCE OF PASSENGER CONVEYOR

(71) Applicant: Otis Elevator Company, Farmington, CT (US)

(72) Inventors: LongWen Wang, Shanghai (CN); ZhaoXia Hu, Hangzhou (CN); Hui Fang, Shanghai (CN); Zhen Jia, Shanghai (CN); Jianwei Zhao, Shanghai (CN); Qiang Li, Shanghai (CN); Anna Su, Shanghai (CN); Alan Matthew Finn, Hebron, CT (US); Gero Gschwendtner, Pressbaum (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/663,463

(22) Filed: Jul. 28, 2017

(65) Prior Publication Data

US 2018/0029840 A1 Feb. 1, 2018

(30) Foreign Application Priority Data

Jul. 29, 2016 (CN) ..... 2016 1 0610340

(51) Int. Cl.
*B66B 29/02* (2006.01)
*B66B 29/04* (2006.01)
(Continued)

(52) U.S. Cl.
CPC ..... *B66B 29/04* (2013.01); *B66B 21/02* (2013.01); *B66B 25/003* (2013.01)

(58) Field of Classification Search
CPC ..... B66B 29/005; B66B 29/02; B66B 29/04; B66B 25/03
(Continued)

(56) References Cited

U.S. PATENT DOCUMENTS 5,092,446 A * 3/1992 Sullivan, Jr. ..... B66B 29/04 198/323
5,099,977 A * 3/1992 Hirose ..... B66B 23/02 198/323
(Continued)

FOREIGN PATENT DOCUMENTS

CN 102234058 A 11/2011
CN 105731236 A 7/2016
(Continued)

OTHER PUBLICATIONS

Extended European Search Report issued in EP Application No. 17184135 dated Dec. 15, 2017, 9 pages.

*Primary Examiner* — Douglas A Hess
(74) *Attorney, Agent, or Firm* — Cantor Colburn LLP

(57) ABSTRACT

The present invention provides a handrail entry monitoring system of a passenger conveyor and a monitoring method thereof, and belongs to the field of passenger conveyor technologies. In the handrail entry monitoring system and the monitoring method of the present invention, at least part of a handrail entry region of the passenger conveyor is sensed by using an imaging sensor and/or a depth sensing sensor, to acquire a data frame, and the data frame is analyzed to monitor whether a handrail entry of the operating passenger conveyor is in a normal state or an abnormal state. The monitoring system of the present invention and the monitoring method thereof can timely and effectively detect a danger that a foreign matter is about to be entrapped into the handrail entry, helping prevent foreign matters from being entrapped into the handrail entry, thereby improving safety of the passenger conveyor.

23 Claims, 3 Drawing Sheets

(51) Int. Cl.
*B66B 21/02* (2006.01)
*B66B 25/00* (2006.01)

(58) Field of Classification Search
USPC ..... 198/322, 323, 324, 325
See application file for complete search history.

(56) References Cited

U.S. PATENT DOCUMENTS 5,245,315 A * 9/1993 Johnson ..... B66B 29/04 198/323
5,366,060 A * 11/1994 Johnson ..... B66B 29/04 198/323
5,443,145 A * 8/1995 Schoeneweiss ..... B66B 29/04 198/323
5,526,256 A * 6/1996 Sakata ..... B66B 25/00 198/323
5,785,165 A * 7/1998 Stahlhut ..... B66B 25/00 198/322
6,112,166 A * 8/2000 Joosten ..... B66B 27/00 198/323
6,334,522 B2 * 1/2002 Haruta ..... B66B 25/00 198/322
6,606,538 B2 8/2003 Ponsot et al.
7,002,462 B2 2/2006 Welch
7,482,771 B2 * 1/2009 Hahn ..... G05B 19/19 187/209
8,205,735 B2 * 6/2012 Behan ..... B66B 29/005 198/323
8,794,421 B2 * 8/2014 Senger ..... B66B 29/005 198/322
8,839,942 B2 * 9/2014 Tautz ..... B66B 29/005 198/323
8,973,731 B2 * 3/2015 Ma ..... B66B 23/02 198/323
8,997,968 B2 * 4/2015 Braasch ..... B66B 25/006 198/322
9,695,016 B2 * 7/2017 Sonnenmoser ..... B66B 5/0037
9,731,904 B2 * 8/2017 Raassina ..... B66B 25/006
9,896,309 B2 * 2/2018 Wang ..... B66B 25/00
2005/0088520 A1 4/2005 Wiesinger et al.
2007/0170037 A1 7/2007 Kuroda
2015/0317517 A1 11/2015 Quan et al.
2018/0029833 A1 * 2/2018 Li et al.
2018/0029841 A1 * 2/2018 Li et al.
2018/0029842 A1 * 2/2018 Li et al.

FOREIGN PATENT DOCUMENTS

DE 102012220702 A1 5/2014
FR 2773791 A1 7/1999
JP H10187230 A 7/1998
JP 2000034087 A 2/2000
JP 2000137790 A 5/2000
JP 2000255964 A 9/2000
JP 2006027790 A 2/2006
JP 2008084269 A 4/2008
JP 2008201509 A 9/2008
WO 2015090764 A1 6/2015
WO 2015171774 A1 11/2015

* cited by examiner

SYSTEM AND METHOD FOR MONITORING HANDRAIL ENTRANCE OF PASSENGER CONVEYOR

This application claims priority to Chinese Patent Application No. 201610610340.5, filed July 29, 2016, and all the benefits accruing therefrom under 35U.S.C. § 119, the contents of which in its entirety are herein incorporated by reference.

TECHNICAL FIELD

The present invention belongs to the field of Passenger Conveyor technologies, and relates to automatic monitoring of a foreign matter at a Handrail Entry of a Handrail of a passenger conveyor.

BACKGROUND ART

A passenger conveyor (such as an escalator or a moving walk) is increasingly widely used in public places such as subways, shopping malls, and airports, and operation safety thereof is increasingly important.

The passenger conveyor has a moving step and a moving handrail. During operation, the handrail circularly slides and enters a handrail entry according to a predetermined direction. Therefore, there is a possibility that an external foreign matter is entrapped into the handrail entry. Especially, if a body part of a passenger is located on the handrail near the handrail entry, there is a risk that the body is entrapped into the handrail entry. For example, a child playing at the handrail exit and entry may place his/her hand on the handrail near the handrail entry, and at this point, the hand is in danger of being entrapped.

In the prior art, whether an external foreign matter is entrapped into the handrail entry is detected by disposing a safety switch in the passenger conveyor, and when it is detected that a foreign matter is entrapped into the handrail entry, the safety switch is triggered and the passenger conveyor is stopped, to avoid expansion of an accident. However, before the safety switch is triggered, a foreign matter has been entrapped into the handrail entry, and generally, an accident has taken place.

SUMMARY OF THE INVENTION

According to one aspect of the present invention, a handrail entry monitoring system of a passenger conveyor is provided, including: an imaging sensor and/or a depth sensing sensor configured to sense at least part of a handrail entry region of the passenger conveyor to acquire a data frame; and a processing apparatus configured to analyze the data frame to monitor whether a handrail entry of the operating passenger conveyor is in a normal state or an abnormal state, wherein the normal state refers to that no foreign matter is about to enter or is already at least partially in a dangerous region of the handrail entry, and the abnormal state refers to that a foreign matter is about to enter or is already at least partially in the dangerous region of the handrail entry.

According to another aspect of the present invention, a handrail entry monitoring method of a passenger conveyor is provided, including steps of: sensing, by an imaging sensor and/or a depth sensing sensor, at least part of a handrail entry region of the passenger conveyor to acquire a data frame; and analyzing the data frame to monitor whether a handrail entry of the operating passenger conveyor is in a normal state or an abnormal state; wherein the normal state refers to that no foreign matter is about to enter or is already at least partially in a dangerous region of the handrail entry, and the abnormal state refers to that a foreign matter is about to enter or is already at least partially in the dangerous region of the handrail entry.

According to a further aspect of the present invention, a passenger conveying system is provided, including a passenger conveyor and the handrail entry monitoring system described above.

The foregoing features and operations of the present invention will become more evident according to the following descriptions and the accompanying drawings.

BRIEF DESCRIPTION OF THE DRAWINGS

In the following detailed description with reference to the accompanying drawings, the foregoing and other objectives and advantages of the present invention would be more complete and clearer, wherein identical or similar elements are indicated with identical reference signs.

DETAILED DESCRIPTION

The present invention is now described more completely with reference to the accompanying drawings. Exemplary embodiments of the present invention are illustrated in the accompanying drawings. However, the present invention may be implemented in lots of different forms, which should not be understood as being limited to the embodiments described herein. On the contrary, the embodiments are provided to make the disclosure thorough and complete, and fully convey the concept of the present invention to those skilled in the art.

Some block diagrams shown in the accompanying drawings are functional entities, and do not necessarily correspond to physically or logically independent entities. The functional entities may be implemented in the form of software, or the functional entities are implemented in one or more hardware modules or an integrated circuit, or the functional entities are implemented in different processing apparatuses and/or microcontroller apparatuses.

In the present invention, the passenger conveyor includes an Escalator and a Moving Walk. In the following illustrated embodiments, the handrail entry monitoring system and monitoring method according to the embodiments of the present invention are described in detail by taking the escalator as an example. However, it should be appreciated that the handrail entry monitoring system and monitoring method for an escalator in the following embodiments may also be analogically applied to a moving walk, in which adaptive improvements or the like that may need to be performed can be obtained by those skilled in the art with the teachings of the embodiments of the present invention.

It should be noted that, in the present invention, that the handrail entry of the passenger conveyor is in a "normal state" refers to that no foreign matter is about to enter or is already at least partially in a dangerous region of the handrail entry; on the contrary, an "abnormal state" refers to that a foreign matter is about to enter or is already at least partially in the dangerous region of the handrail entry. The dangerous region refers to that a foreign matter in this spatial region has a possibility of being entrapped into the handrail entry when the handrail operates at a predetermined speed. Therefore, the dangerous region is a relative concept, and may be set according to a specific condition. For example, if the operating speed of the handrail is faster, the dangerous region may be expanded accordingly; if there is a higher requirement for the safety of the passenger conveyor, the dangerous region may be expanded accordingly, and so on.

Figure 1:
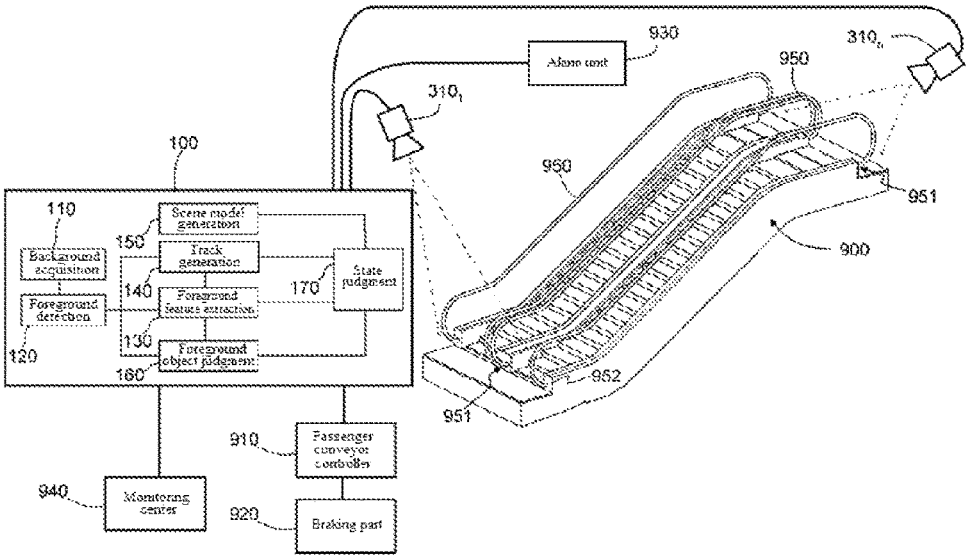
FIG. 1 is a schematic structural diagram of a handrail entry monitoring system of a passenger conveyor according to an embodiment of the present invention.
Figure 2:
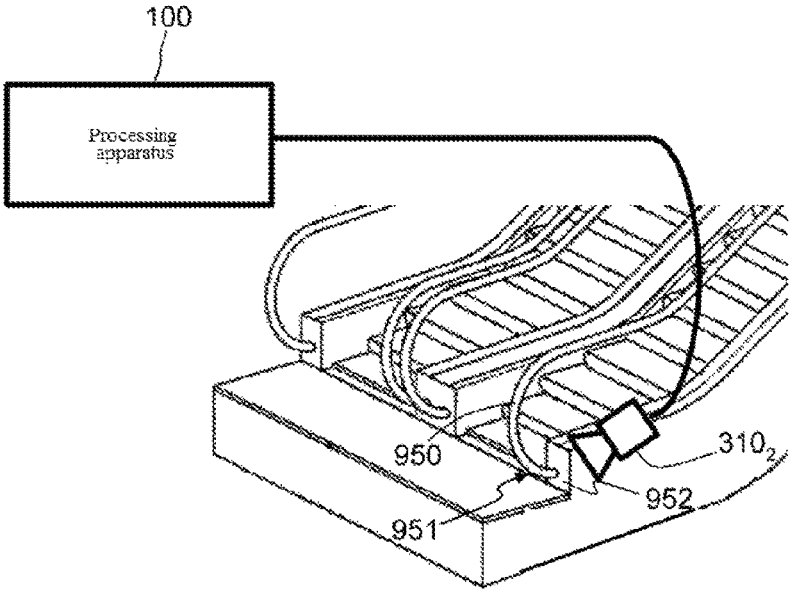
FIG. 2 is a schematic diagram of mounting of a sensing apparatus of a passenger conveyor according to an embodiment of the present invention.
Figure 3:
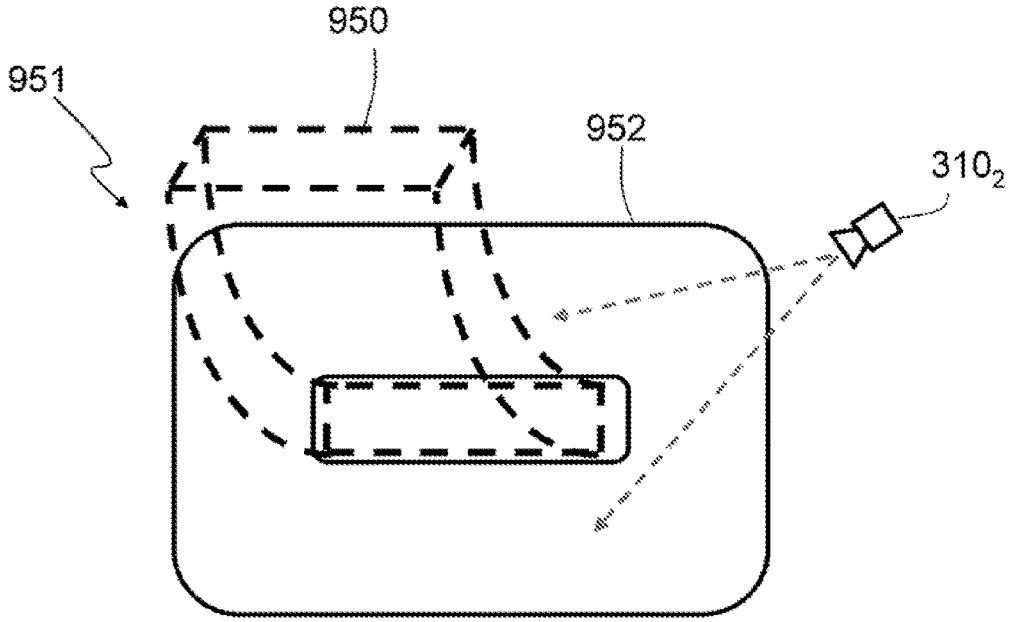
FIG. 3 is a schematic diagram showing that the sensing apparatus shown in FIG. 2 monitors a handrail entry region.

FIG. 1 is a schematic structural diagram of a handrail entry monitoring system of a passenger conveyor according to an embodiment of the present invention. FIG. 2 is a schematic diagram of mounting of a sensing apparatus of a passenger conveyor according to an embodiment of the present invention. FIG. 3 is a schematic diagram showing that the sensing apparatus shown in FIG. 2 monitors a handrail entry region. Referring to FIG. 1 to FIG. 3, the handrail entry monitoring system of this embodiment may be configured to constantly monitor, in a predetermined time period, whether a handrail entry region 951 of a handrail 950 of an escalator 900 is in a normal state when the passenger conveyor is under a daily operation condition (including an operation condition with passengers and a no-load operation condition without passengers).

Under the daily operation condition, the handrail 950 continuously turns around and operates in a direction at a predetermined speed, and the operating speed thereof may change. It should be further understood that the operating direction thereof also changes. Therefore, the handrail entry of the handrail entry region 951 is a relative concept. For example, when the step and the handrail 950 operate upwards in FIG. 1, an upper end is a handrail entry, and a lower end is a handrail exit; on the contrary, when the step and the handrail 950 operate downwards, the upper end is the handrail exit, and the lower end is the handrail entry. At the handrail exit, an event of a foreign matter being entrapped in may be less likely to happen. Therefore, the monitoring system according to the embodiment of the present invention may or may not be used for monitoring in a time period when an end of the handrail serves as a handrail exit.

Referring to FIG. 1 and FIG. 3, when the handrail entry is in a normal state, the handrail 950 is capable of freely entering an entry of a baffle 952, and at the entry, there is no foreign matter that may be entrapped therein by the handrail 950. The foreign matter refers to an external foreign matter of the escalator 900, which, for example, may be clothes of a passenger, a body part (such as a hand) of a passenger, and the like, and the specific type thereof is not limited.

The handrail entry monitoring system shown in FIG. 1 includes a sensing apparatus 310 and a processing apparatus 100 coupled to the sensing apparatus 310, and the escalator 900 includes a passenger conveyor controller 910, a braking part 920 such as a motor and an alarm unit 930.

The sensing apparatus 310 is specifically an imaging sensor or a depth sensing sensor, or a combination thereof. According to a specific requirement and a monitoring range of a sensor, the escalator 900 may be provided with one or more sensing apparatuses 310, for example, $\mathbf{310}_1$ to $\mathbf{310}_n$, where N is an integer greater than or equal to 1. The sensing apparatus 310 is mounted in such a manner that it can relatively clearly and accurately sense the entry region 951 of the escalator 900 with the largest viewing angle, and the specific mounting manner and mounting position thereof are not limited. In the embodiment shown in FIG. 1, there are two sensing apparatuses 310, which are correspondingly arranged at inclined tops of exit and entry regions at two ends of the escalator 900 respectively and substantially face the handrail entry region 951. It should be understood that, to make a monitoring viewing angle more comprehensive, multiple sensing apparatuses 310 may be mounted for a same handrail entry region 951. For example, as shown in FIG. 2 and FIG. 3, the sensing apparatus 310 further includes one or more sensing apparatuses $\mathbf{310}_2$ (imaging sensors or depth sensing sensors) mounted around the handrail entry. It should be understood that, to accurately sense the handrail entry region 951, imaging sensors or depth sensing sensors of a corresponding type may be selected according to a specific application environment, and even corresponding lighting lamps and the like may be configured around the handrail entry (when the sensing apparatuses 310 are imaging sensors).

The imaging sensor may be a 2D image sensor of various types. It should be understood that any image sensor capable of capturing an image frame including pixel grayscale information may be applied herein. Definitely, image sensors capable of capturing an image frame including pixel grayscale information and color information (such as RGB information) may also be applied herein.

The depth sensing sensor may be any 1D, 2D or 3D depth sensor or a combination thereof, and to accurately sense handrail parts and the like at the handrail entry region 951 and foreign matters that possibly appear, a depth sensing sensor of a corresponding type may be selected according to a specific application environment. Such a sensor is operable in an optical, electromagnetic or acoustic spectrum capable of producing a depth map (also known as a point cloud or occupancy grid) with a corresponding texture. Various depth sensing sensor technologies and devices include, but are not limited to, structured light measurement, phase shift measurement, time-of-flight measurement, a stereo triangulation device, an optical triangulation device plate, a light field camera, a coded aperture camera, a computational imaging technology, simultaneous localization and map-building (SLAM), an imaging radar, an imaging sonar, an echolocation device, a scanning LIDAR, a flash LIDAR, a passive infrared (PIR) sensor, and a small focal plane array (FPA), or a combination including at least one of the foregoing. Different technologies may include active (transmitting and receiving a signal) or passive (only receiving a signal) technologies and are operable in a band of electromagnetic or acoustic spectrum (such as visual and infrared). Depth sensing may achieve particular advantages over conventional 2D imaging. Infrared sensing may achieve particular benefits over visible spectrum imaging. Alternatively or additionally, the sensor may be an infrared sensor with one or more pixel spatial resolutions, e.g., a passive infrared (PIR) sensor or a small IR focal plane array (FPA).

It should be noted that there may be property and quantity differences between a 2D imaging sensor (e.g., a conventional security camera) and the 1D, 2D, or 3D depth sensing sensor in terms of the extent that the depth sensing provides numerous advantages. In 2D imaging, a reflected color (a mixture of wavelengths) from the first object in each radial direction of the imager is captured. A 2D image, then, may include a combined spectrum of source lighting and a spectral reflectivity of an object in a scene. The 2D image may be interpreted by a person as a picture. In the 1D, 2D, or 3D depth-sensing sensor, there is no color (spectrum)

information; more specifically, a distance (depth, range) to a first reflection object in a radial direction (1D) or directions (2D, 3D) from the sensor is captured. The 1D, 2D, and 3D technologies may have inherent maximum detectable range limits and may have a spatial resolution relatively lower than that of a typical 2D imager. In terms of relative immunity to ambient lighting problems, compared with the conventional 2D imaging, the 1D, 2D, or 3D depth sensing may advantageously provide improved operations, and better separation and better privacy protection of shielded objects. Infrared sensing may achieve particular benefits over visible spectrum imaging. For example, it is possible that a 2D image cannot be converted into a depth map and a depth map does not have a capability of being converted into a 2D image (for example, artificial allocation of continuous colors or grayscale to continuous depths may cause a person to roughly interpret a depth map in a manner somewhat akin to how a person sees a 2D image, while the depth map is not an image in a conventional sense).

When the sensing apparatus 310 is specifically a combination of an imaging sensor and a depth sensing sensor, the sensing apparatus 310 may be an RGB-D sensor, which may acquire RGB information and depth (D) information at the same time.

The sensing apparatus 310 senses the handrail entry region 951 of the escalator 900 and obtains multiple data frames, that is, sequence frames, in real time; if an imaging sensor is used for sensing and acquisition, the sequence frames are multiple image frames, wherein each pixel has, for example, corresponding grayscale information and color information; if a depth sensing sensor is used for sensing and acquisition, the sequence frames are multiple depth maps, wherein each pixel or occupancy grid also has a corresponding depth dimension (reflecting depth information).

If it is necessary to monitor the handrail entry region 951 all the time, multiple sensing apparatuses 310 that can operate at the same time to acquire corresponding data frames are correspondingly mounted at the handrail entry region 951, to comprehensively monitor various parts of a same handrail entry region 951. The data frames acquired by each sensing apparatus are transmitted to and stored in a processing apparatus 100. The above process of sensing and acquiring data frames by the sensing apparatus 310 may be implemented under the control of the processing apparatus 100 or the passenger conveyor controller 910. The processing apparatus 100 is further responsible for analyzing each data frame, and finally obtaining information indicating whether the handrail entry region 951 of the escalator 900 is in a normal state, for example, determining whether a foreign matter is in a dangerous region of the handrail entry.

Continuously as shown in FIG. 1, the processing apparatus 100 is configured to include a background acquisition module 110 and a foreground detection module 120. In the background acquisition module 110, a 3D depth map when the handrail entry of the escalator 900 is in a normal state (for example, the handrail entry region 951 has no foreign matter) is learned to acquire a background model. The background model may be established in an initialization stage of the handrail entry monitoring system, that is, before the handrail entry region 951 under a daily operation condition is monitored, the handrail entry monitoring system is initialized to obtain the background model. The background model may be established through learning by using, but not limited to, a Gaussian Mixture Model (GMM), a Code Book Model, Principle Components Analysis (PCA), Robust Principle Components Analysis (RPCA), Mean Filtering, Neural Network Methods (including deep learning), Kernel Density Estimation methods (KDE), Adaptive Kernel Density Estimation (AKDE), Recursive modeling (RM) or Support Vector data description modeling (SVDDM). The depth map acquired by the depth sensing sensor is learned to obtain a background model, which a typical depth background model; the image frame acquired based on the imaging sensor is learned to obtain a background model, which a typical grayscale background model or a chromaticity background model.

It should be understood that, in the following handrail entry monitoring stage, the background model may be updated adaptively. When an application scene, sensor type or setting changes, a corresponding background model may be acquired through re-learning in the initialization stage, or adaptive updating may be performed in real time, for example, by using a method such as GMM or RPCA.

The foreground detection module 120 is configured to compare a depth map or image acquired in real time with the background model to obtain a foreground object. Specifically, during the comparison, if an imaging sensor is used, the data frame is a 2D image, the background model is also formed based on a 2D image, and the comparison process may specifically be differential processing. For example, a pixel in the 2D image is compared with a corresponding pixel of the background model to calculate a difference (e.g., a grayscale difference), the pixel is retained when the difference is greater than a predetermined value, and thus a foreground object can be obtained. If a depth sensing sensor is used, the data frame is a depth map, and the background model is also formed based on a 3D depth map. For example, an occupancy grid of the depth map may be compared with a corresponding occupancy grid in the background model (e.g., a depth difference is calculated), depth information of the occupancy grid is retained (indicating that the occupancy grid is) when the difference is greater than a predetermined value, and thus a foreground object can be obtained.

If a foreign matter is placed on the handrail 950 or in other situations where the foreign matter enters a dangerous region of the handrail entry 951, the corresponding data frame portion is compared with the corresponding portion of the background model, and the obtained foreground object may also include related features reflecting the foreign matter.

In an embodiment, the foreground detection module 120 is further provided with a foreground filtering sub-module (not shown in FIG. 1), configured to filter the foreground object obtained through comparison. Specifically, for example, filtering technologies such as a Morphological filtering technology and a Geometric filtering technology may be used, so that small regions, sporadic pixels/volume elements (i.e., one or more grids), non-pertinent objects and so on can be removed, to form a filtered foreground object.

By taking the Morphological filtering technology as an example, morphological filtering can be used to remove a corresponding foreground object if selected features (e.g., height, width, aspect ratio, volume, and the like) are outside a corresponding threshold (e.g., a dynamically calculated threshold, a static threshold, or the like). By taking the Geometric filtering technology as an example, geometric filtering can be used to further remove spurious foreground objects outside the scene boundary. For example, the depth map-based background model defines an environment boundary of a 3D scene. If the depth of a blob is greater than the corresponding depth dimension of the background model, the blob is outside of the environment boundary of the 3D scene and can be removed. In practice, the blob is possibly formed by surface-emitting of a shiny floor plate, and is absolutely not a foreign matter.

In an embodiment, as shown in FIG. 1, the processing apparatus 100 is further provided with a Scene Model generation module 150, which generates a scene model based on a data frame sensed when the handrail entry of the passenger conveyor is in the normal state, to define the monitored dangerous region. The scene model includes 1D, 2D, or 3D geometrical information of the handrail entry, and further includes a monitored line, area or volume, so that a dangerous region can be defined. It should be noted that the dangerous region is defined in the handrail entry region 951. For the imaging sensor, the dangerous region is defined with a 2D region. For the depth sensing sensor, the dangerous region is defined with a 3D spatial region (volume). Specifically, it is possible to define a 2D region or a 3D spatial region in advance by artificially drawing, by a builder, a line on a data frame for acquiring a background model, and generate a scene model through learning, where the drawn line reflects the dangerous region. Therefore, as stated above, the dangerous region is a relative concept, which can be artificially and subjectively set.

Continuously as shown in FIG. 1, the processing apparatus 100 is further provided with a foreground feature extraction module 130. The foreground feature extraction module 130 extracts a corresponding foreground feature from the filtered foreground object. To monitor whether a foreign matter enters the dangerous region of the handrail entry, the extracted foreground feature includes information such as a position feature of the foreground object, which may be defined by using a value of a distance (a 2D image plane distance or a 3D distance) from a feature point or pixel/grid to a reference point. It should be understood that the foreground feature extracted by the foreground feature extraction module 130 from the foreground object is not limited to the position feature, and may further include shape, size and other features.

Continuously as shown in FIG. 1, the processing apparatus 100 further includes a state judgment module 170. The state judgment module 170 is coupled to the foreground feature extraction module 130 and can acquire the position feature therefrom. The state judgment module 170 is further coupled to the scene model generation module 150, so that the corresponding dangerous region can be obtained therefrom. The state judgment module 170 judges, based on the position feature, whether the corresponding foreground object is in the dangerous region of the handrail entry, and determines, when the judgment result is "yes", that the handrail entry is in a normal state.

Specifically, if the position feature of the foreground object is indicated with distance information relative to a reference point, the distance information may be compared with distance information of a corresponding reference point relative to the dangerous region defined by the scene model. For example, if the difference is less than a threshold, it is determined that the foreground object enters the dangerous region, the foreign matter of the foreground object may enter the dangerous region, and it is determined that the handrail entry is in an abnormal state; on the contrary, it is determined that the handrail entry is in a normal state.

In an embodiment, as shown in FIG. 1, the processing apparatus 100 is further provided with a track generation module 140. The track generation module 140 generates, according to foreground objects obtained corresponding to multiple continuous data frames, a movement track of a target foreground object. Specifically, for all filtered foreground objects acquired by the foreground detection module 120, a Bayesian Filter technology may be used in the track generation module 140, to implement, for example, tracking of the foreground objects of the continuous data frames, such that a same corresponding foreground object can be obtained by tracking according to multiple foreground objects obtained in data frames in a predetermined time period. Further, according to position information of the same foreground object tracked in each data frame acquired by the track generation module 140, a movement track of a foreign matter corresponding to the foreground object in the handrail entry region 951 in the predetermined time period is generated. The above specific Bayesian Filter technology may be, for example, but is not limited to, Kalman Filter, Particle Filter, and the like.

By taking that the foreign matter is a foreground object corresponding to a hand as an example, position information of the foreground object corresponding to the hand in each frame is extracted and obtained in the foreground feature extraction module 130, and the track generation module 140 can generate, according to the foreground object (hand) in each frame tracked by using a filter technology and with reference to position information of the foreground object (hand) in each frame, a movement track of the foreground object of the hand.

Correspondingly, the state judgment module 170 may be coupled to the track generation module 140, and pre-judge movement of the foreign matter by using the movement track. The state judgment module 170 may pre-judge, based on a movement track of a target foreground object (e.g., hand), whether the target foreground object is about to enter the dangerous region of the handrail entry even if the target foreground object (e.g., hand) has not yet entered the dangerous region (i.e., judgment is made by the state judgment module 170 based on the position information), and also determine, when the judgment result is "yes", that the handrail entry is in an abnormal state. The embodiment may make pre-judgment when a foreign matter has not yet entered but is about to enter the dangerous region of the handrail entry, thereby gaining response time for the control over the escalator. When it is absolutely necessary to avoid entrapment of a foreign matter, the solution of this embodiment may be adopted, for example, when it is absolutely necessary to avoid entrapment of a foreign matter such as a hand, according to the movement track which is generated in the track generation module 140 and corresponding to the movement of the hand at the handrail, the state judgment module 170 may pre-judge a dangerous situation, thereby gaining time for a braking operation and response of the escalator, which can effectively prevent a foreign matter such as a hand from being entrapped into the handrail entry, and improve operation safety of the escalator.

In the above pre-judgment process, expected distance related information relative to a reference point may be calculated based on the movement track, and thus the expected distance related information may also be compared with distance information of a corresponding reference point relative to the dangerous region defined by the scene model, for example, if the difference is less than a threshold, it is determined that the foreground object will enter the dangerous region at an expected time point.

In an embodiment, as shown in FIG. 1, the processing apparatus 100 is further provided with a foreground object judgment module 160. The foreground object judgment module 160 is also coupled to the state judgment module 170, and is capable of sending a judgment result for the foreground object to the state judgment module 170. In this embodiment, correspondingly, the foreground feature extraction module 130 is further configured to be capable of extracting, from the foreground object, the foreground object, an object texture, and one or more of a shape feature, a color feature, a size feature, a Scale Invariant Feature Transform (SIFT) feature, a corner feature, a Principal Component feature, and the like, and the foreground object judgment module 160 acquires the foreground object, the texture and/or the above features, to judge and determine whether the foreground object is a foreign matter (e.g., a hand of a passenger) that needs to completely avoid being entrapped. The judgment process may include classifying the foreground object and/or feature by using the following classifier modules or methods: Clustering Classifiers, Support Vector Machine (SVM) classifiers, Neural Network (NN) classifiers, and Decision Trees and Forests classifiers. Based on the position feature of the foreground object of the foreign matter and/or the classification of the foreground object, the state judgment module 170 judges whether the foreground object corresponding to the foreign matter that needs to completely avoid being entrapped is in a neighboring region of the dangerous region of the handrail entry. The setting of the neighboring region is equivalent to an expansion of the range of the dangerous region (with respect to the foreign matter that needs to completely avoid being entrapped). Therefore, when the foreign matter that needs to completely avoid being entrapped has not yet entered the dangerous region but is about to enter the dangerous region, a danger may be anticipated earlier or in advance if the foreign matter has entered the neighboring region. In this case, the processing apparatus 100 may control the escalator 900 by using a response the same as the response to the judgment that the handrail entry is in an abnormal state, for example, immediate braking is carried out to prevent a hand or the like from being entrapped, which also effectively improves the safety of the escalator.

The specific setting of the neighboring region may depend on a specific situation, for example, an operating speed of the handrail 950 and the like. The neighboring region may be defined by the scene model generation module 150, and the specific defining method thereof is similar to the defining method of the dangerous region. The neighboring region may also be regarded as a buffer region of the dangerous region.

It should be noted that, under most monitoring circumstances, the data frame acquired by the sensing apparatus 310 is, as a matter of fact, basically the same as the background model obtained by calculation (for example, there is no foreign matter at all at the detected handrail entry region 951 of the escalator 900). In this case, there is basically no foreground object in the foreground detection module 120 (for example, there is only noise information), and at this point, the state judgment module 170 may directly determine that the handrail entry is in a normal state, that is, there is no foreign matter at the handrail entry region 951, and thus it is not necessary to make judgment based on the foreground feature extracted by the foreground feature extraction module 130, which improves the efficiency of the judgment.

When the state judgment module 170 in the processing apparatus 100 of the above embodiment determines that the monitored handrail entry is in an abnormal state (for example, a hand enters or is about to enter the dangerous region), a corresponding signal may be sent to the passenger conveyor controller 910 of the escalator 900, to take corresponding measures. For example, the controller 910 further sends a signal to the braking part 930 to reduce a step operating speed or carry out braking. The processing apparatus 200 may further send a signal to the alarm unit 930 mounted above the escalator 900 to remind the passenger to watch out, for example, make an alarm sound. Definitely, the processing apparatus 200 may further send a signal to a monitoring center 940 or the like of a building, to prompt that a site processing needs to be performed in time, or prompt that the escalator 900 needs to be controlled manually according to a site monitoring picture. The measures specifically taken when it is found that the handrail entry of the escalator 900 is in the abnormal state are not limited.

The handrail entry monitoring system in the embodiment shown in FIG. 1 can automatically monitor the handrail entry of the escalator 900 in real time, and can timely and effectively find the possibility that a foreign matter is entrapped into the handrail entry, which, compared with the solution of the prior art in which a safety switch is arranged to detect whether a foreign matter is entrapped into the handrail entry, can make a response in advance before the foreign matter is entrapped into the handrail entry, so as to make corresponding control, for example, a braking operation, thus directly and effectively avoiding an accident. In particular, a pre-judgment function may also be implemented in combination with the function of the track generation module 140, or the possibility of a danger can be found in advance in combination with the function of the foreground object judgment module 160, achieving a better advance response effect and higher safety of the passenger conveyor such as the escalator.

It should be understood that, when the monitoring system of the embodiment of the present invention performs monitoring based on the depth map obtained by the depth sensing sensor, the sensing of the depth sensing sensor for a local small region of the handrail entry is more accurate, and an influence caused by that the light intensity near the handrail entry is easy to change (for example, a passenger passing by easily affects the light intensity at the handrail entry significantly) can be fully avoided. The characteristic that the depth sensing sensor is immune to changes in ambient light intensity is made good use of. Therefore, the accuracy in terms of a background model, a foreground object, a foreground feature, a dangerous region, foreground object judgment, and a movement track and the like will be improved, and the accuracy of the judgment is also improved. Moreover, when the 2D image obtained based on the imaging sensor is monitored, as the dangerous region can only be defined with a 2D plane region, the judgment of whether the handrail entry is in a normal state made based on the 2D dangerous region is less accurate than that based on a 3D dangerous region.

Figure 4:
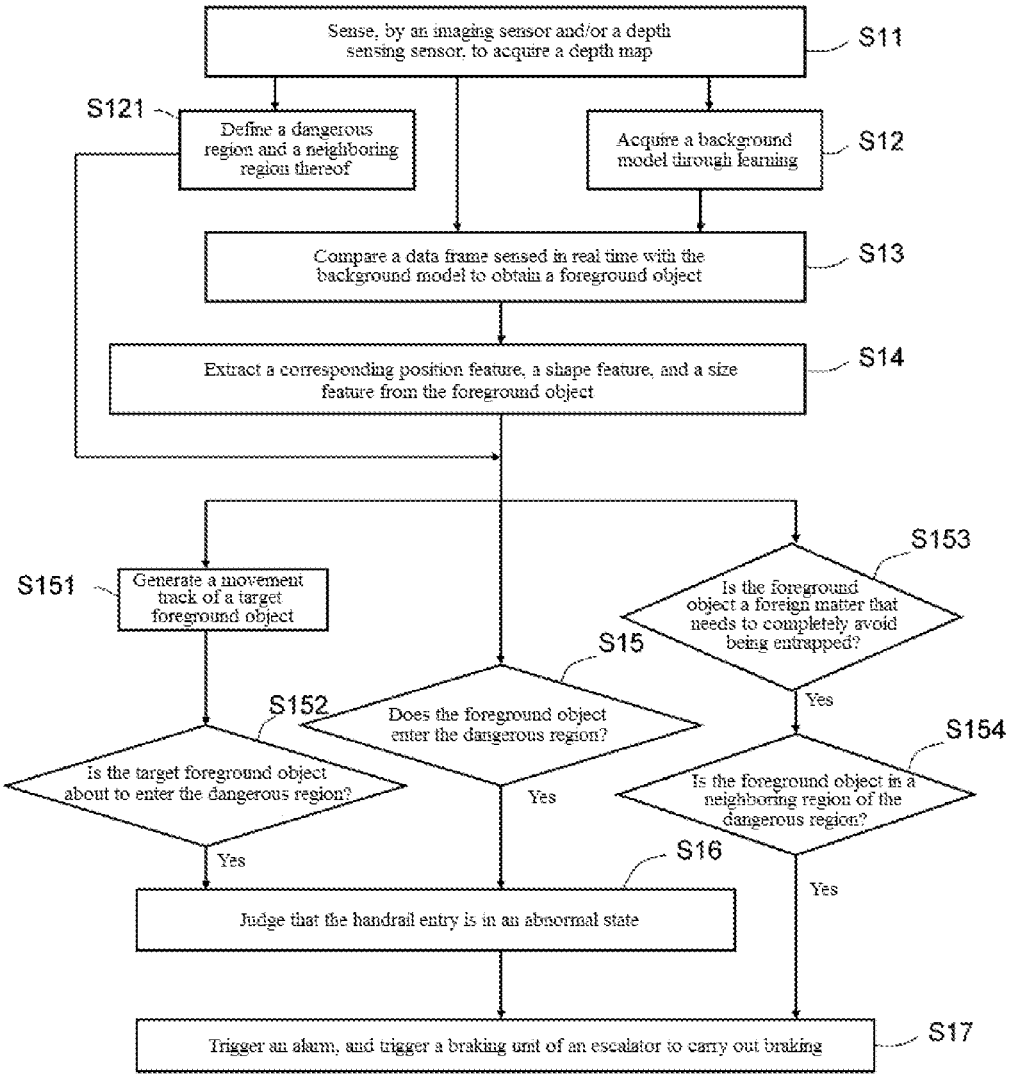
FIG. 4 is a schematic flowchart of a handrail entry monitoring method of a passenger conveyor according to an embodiment of the present invention.

A process of a method of monitoring whether the handrail entry is in a normal state based on the handrail entry monitoring system in the embodiment shown in FIG. 1 is illustrated by using the following FIG. 4. The working principle of the handrail entry monitoring system according to the embodiment of the present invention is further described with reference to FIG. 1 and FIG. 4.

First of all, in step S11, at least part of a handrail entry region of the passenger conveyor is sensed by an imaging sensor and/or a depth sensing sensor, to acquire a data frame. It should be noted that, when a background model is acquired through learning or a dangerous region and a neighboring region thereof are defined, the data frame is sensed and acquired when the handrail entry is in a normal state (the handrail entry of the escalator 900 has no foreign matter). Under other circumstances, the data frame is acquired at any time under a daily operation condition. For example, 30 continuous data frames can be acquired per second, and the acquired data frames are provided for subsequent real-time analysis.

Further, in step S12, a background model is acquired based on a data frame sensed when the handrail entry of the passenger conveyor is in the normal state. This step is accomplished in the background acquisition module 110 as shown in FIG. 1, and can be implemented in an initialization stage of the system. Reference may be made to the description about the background acquisition module 110 for the specific method of acquiring the background model.

In an embodiment, step S121 is further performed, in which the monitored dangerous region is defined based on the data frame sensed when the handrail entry of the passenger conveyor is in the normal state, and at the same time, a neighboring region of the dangerous region may further be defined. This step is accomplished in the scene model generation module 150 as shown in FIG. 1. Reference may be made to the description about the scene model generation module 150 for the specific method of defining the dangerous region or the neighboring region thereof.

Step S12 and step S121 may be accomplished offline.

Further, in step S13, the data frame sensed in real time in step S11 is compared with the background model to obtain a foreground object. This step is accomplished in the foreground detection module 120, and the foreground object may be sent to the state judgment module 170 for analysis. In an embodiment, the foreground object may also be sent to the track generation module 140 and/or the foreground object judgment module 160. Reference may be made to the description about the foreground detection module 120 for the specific method of obtaining the foreground object.

Further, in step S14, a corresponding foreground feature is extracted from the foreground object. This step is accomplished in the foreground feature extraction module 130. The extracted foreground feature includes a position feature, and further includes, but is not limited to, information such as a shape feature and a size feature of the foreground object. By taking the depth map acquired by the depth sensing sensor as an example, shape, size and position features are embodied by changes in a depth value of an occupancy grid in the foreground object. Reference may be made to the description about the foreground feature extraction module 130 for the specific method of extracting the foreground feature.

It should be noted that, herein, the shape feature (descriptor) may be calculated through a technology such as histogram of oriented gradients (HoG), Zernike moment, Centroid Invariance to boundary point distribution, or Contour Curvature. Other features may be extracted to provide additional information for shape (or morphological) matching or filtering. For example, the other features may include, but are not limited to, Scale Invariant Feature Transform (SIFT), a Speed-Up Robust Feature (SURF) algorithm, Affine Scale Invariant Feature Transform (ASIFT), other SIFT variables, Harris Corner Detector, a Smallest Univalue Segment Assimilating Nucleus (SUSAN) algorithm, Features from Accelerated Segment Test (FAST) corner detection, Phase Correlation, Normalized Cross-Correlation, a Gradient Location Orientation Histogram (GLOH) algorithm, a Binary Robust Independent Elementary Features (BRIEF) algorithm, a Center Surround Extremas (CenSure/STAR) algorithm, an Oriented and Rotated BRIEF (ORB) algorithm and other features. The shape feature may be compared or classified as a shape, wherein one or more of the following technologies are used: clustering, Deep Learning, Convolutional Neural Networks, Recursive Neural Networks, Dictionary Learning, a Bag of visual words, a Support Vector Machine (SVM), Decision Trees, Fuzzy Logic, and so on.

Further, in step S15, whether the foreground object is in the dangerous region of the handrail entry is judged based on the position feature, and if the judgment result is "yes", it indicates that a foreign matter enters the dangerous region at present, and it is determined that the handrail entry is in an abnormal state, that is, the process proceeds to step S16. Step S15 and step S16 are accomplished in the state judgment module 170. Reference may be made to the description about the state judgment module 170 for the specific judgment method.

In an embodiment, step S151 and step S152 are further performed.

In step S151, a movement track of a target foreground (e.g., a foreground object corresponding to a hand of a passenger) object is generated according to foreground objects obtained corresponding to multiple continuous data frames. Step S151 is accomplished in the track generation module 140. Reference may be made to the description about the track generation module 140 for the specific method of generating the movement track of the target foreground object.

In step S152, whether the target foreground object is about to enter the dangerous region of the handrail entry is pre-judged based on the movement track of the target foreground object, and if the judgment result is "yes", it indicates that a foreign matter is about to enter the dangerous region at present, and it is determined that the handrail entry is in an abnormal state, that is, the process proceeds to step S16. Step S152 is accomplished in the state judgment module 170. Reference may be made to the description about the state judgment module 170 for the specific pre-judgment method.

In another embodiment, step S153 and step S154 are further performed.

In step S153, whether the foreground object is a foreign matter (e.g., a hand of a passenger) that needs to completely avoid being entrapped is judged based on the shape feature and the size feature of the foreground object. Step S153 is accomplished in the foreground object judgment module 160. Reference may be made to the description about the foreground object judgment module 160 for the specific judgment method.

In step S154, when it is determined that the foreground object is a foreign matter that needs to completely avoid being entrapped (that is, the judgment result in step S153 is "yes"), whether the foreground object corresponding to the foreign matter that needs to completely avoid being entrapped is in a neighboring region of the dangerous region of the handrail entry is judged based on the position feature. Step S154 is accomplished in the state judgment module 170. Reference may be made to the description about the state judgment module 170 for the specific pre-judgment method. If the judgment result is "yes", the process also proceeds to step S17.

Finally, in step S17, an alarm is triggered, and a braking unit of the escalator is triggered to carry out braking. Specifically, information may be triggered to be sent to the monitoring center 940.

So far, the process of detecting the handrail entry of the escalator 900 has basically ended, and some steps of the process may be repeated and continuously performed, to continuously monitor whether a foreign matter enters the handrail entry region of the escalator 900. The monitoring method can timely and effectively detect a danger that a foreign matter is to be entrapped into the handrail entry, helping prevent the foreign matter from being entrapped into the handrail entry.

It should be noted that the processing apparatus (100 or 200 or 300) in the handrail entry monitoring system in the embodiment shown in FIG. 1 may be arranged separately, or may be specifically arranged in the monitoring center 940 of the building, or may also be integrated with the controller 910 of the escalator 900. The specific setting manner thereof is not limited.

It should be noted that the elements disclosed and depicted herein (including flowcharts and block diagrams in the accompanying drawings) imply logical boundaries between the elements. However, according to software or hardware engineering practices, the depicted elements and the functions thereof may be implemented on machines through a computer executable medium. The computer executable medium has a processor capable of executing program instructions stored thereon as a monolithic software structure, as standalone software modules, or as modules that employ external routines, code, services, and so forth, or any combination thereof, and all such implementations may fall within the scope of the present disclosure.

Although the different non-limiting implementation solutions have specifically illustrated components, the implementation solutions of the present invention are not limited to those particular combinations. It is possible to use some of the components or features from any of the non-limiting implementation solutions in combination with features or components from any of other non-limiting implementation solutions.

Although particular step sequences are shown, disclosed, and claimed, it should be appreciated that the steps may be performed in any order, separated or combined, unless otherwise indicated and will still benefit from the present disclosure.

The foregoing description is exemplary rather than defined as being limited within. Various non-limiting implementation solutions are disclosed herein, however, persons of ordinary skill in the art would recognize that various modifications and variations in light of the above teachings will fall within the scope of the appended claims. It is therefore to be appreciated that within the scope of the appended claims, the disclosure may be practiced other than as specifically disclosed. For that reason, the appended claims should be studied to determine the true scope and content.

What is claimed is:

1. A handrail entry monitoring system of a passenger conveyor, comprising:

an imaging sensor and/or a depth sensing sensor configured to sense at least part of a handrail entry region of the passenger conveyor to acquire a data frame; and a processing apparatus configured to analyze the data frame to monitor whether a handrail entry of the operating passenger conveyor is in a normal state or an abnormal state, wherein the normal state refers to that no foreign matter is about to enter or is already at least partially in a dangerous region of the handrail entry, and the abnormal state refers to that a foreign matter is about to enter or is already at least partially in the dangerous region of the handrail entry;

wherein the processing apparatus further comprises:

a background acquisition module configured to acquire a background model based on a data frame sensed when the handrail entry of the passenger conveyor is in the normal state;

a foreground detection module configured to compare a data frame sensed in real time with the background model to obtain a foreground object;

a foreground feature extraction module configured to extract a corresponding position feature from the foreground object; and a state judgment module configured to judge, at least based on the position feature, whether the foreground object is in the dangerous region of the handrail entry, and determine, when the judgment result is "yes", that the handrail entry is in the abnormal state.

2. The handrail entry monitoring system of claim 1, wherein the processing apparatus is configured to comprise:

a track generation module configured to generate, according to foreground objects obtained corresponding to multiple continuous data frames, a movement track of a target foreground object.

3. The handrail entry monitoring system of claim 2, wherein the state judgment module is further configured to: pre-judge, based on the movement track of the target foreground object, whether the target foreground object is about to enter the dangerous region of the handrail entry, and determine, when the judgment result is "yes", that the handrail entry is in the abnormal state.

4. The handrail entry monitoring system of claim 2, wherein the track generation module is further configured to: track a same foreground target in the multiple continuous data frames by using a Bayesian filter technology, and generate the movement track by using position features of the same foreground target extracted by the foreground feature extraction module from the multiple continuous data frames respectively.

5. The handrail entry monitoring system of claim 1, wherein the processing apparatus is configured to further comprise:

a scene model generation module configured to define, based on the data frame sensed when the handrail entry of the passenger conveyor is in the normal state, the monitored dangerous region.

6. The handrail entry monitoring system of claim 1, wherein the foreground detection module further comprises: a foreground filtering sub-module configured to filter the foreground object.

7. The handrail entry monitoring system of claim 1, wherein the foreground feature extraction module is further configured to extract a foreground object, an object texture, and one or more of a shape feature, a color feature, a size feature, a scale invariant feature transform feature, a corner feature, and a principal component feature;

wherein the processing apparatus is configured to further comprise: a foreground object judgment module configured to judge, based on the foreground object, the object texture, and one or more of the shape feature, the color feature, the size feature, the scale invariant feature transform feature, the corner feature, and the principal component feature, whether the foreground object is a foreign matter that needs to completely avoid being entrapped.

8. The handrail entry monitoring system of claim 1, wherein, in the background acquisition module, the background model is established by using a Gaussian mixture model, code book model learning, principle components analysis, robust principle components analysis, mean filtering, neural network methods, kernel density estimation, adaptive kernel density estimation, recursive modeling or support vector data description modeling.

9. The handrail entry monitoring system of claim 1, wherein the imaging sensor/depth sensing sensor comprises one or more imaging sensors/depth sensing sensors mounted around the handrail entry.

10. The handrail entry monitoring system of claim 1, wherein the handrail entry monitoring system further comprises an alarm unit, and the processing apparatus triggers the alarm unit to operate when determining that the handrail entry is in the abnormal state.

11. The handrail entry monitoring system of claim 1, wherein the processing apparatus is further configured to trigger an output signal to enable a braking part of the passenger conveyor to operate when determining that the handrail entry is in the abnormal state.

12. A passenger conveying system, comprising a passenger conveyor and the handrail entry monitoring system of claim 1.

13. A handrail entry monitoring method of a passenger conveyor, comprising steps of:

sensing, by an imaging sensor and/or a depth sensing sensor, at least part of a handrail entry region of the passenger conveyor to acquire a data frame; and analyzing the data frame to monitor whether a handrail entry of the operating passenger conveyor is in a normal state or an abnormal state;

wherein the normal state refers to that no foreign matter is about to enter or is already at least partially in a dangerous region of the handrail entry, and the abnormal state refers to that a foreign matter is about to enter or is already at least partially in the dangerous region of the handrail entry;

wherein analyzing the data further comprises:

acquiring a background model based on a data frame sensed when the handrail entry of the passenger conveyor is in the normal state;

comparing a data frame sensed in real time with the background model to obtain a foreground object;

extracting a corresponding position feature from the foreground object; and judging, at least based on the position feature, whether the foreground object is in the dangerous region of the handrail entry, and determining, when the judgment result is "yes", that the handrail entry is in the abnormal state.

14. The handrail entry monitoring method of claim 13, wherein the analyzing step further comprises:

generating, according to foreground objects obtained corresponding to multiple continuous data frames, a movement track of a target foreground object.

15. The handrail entry monitoring method of claim 14, wherein, in the step of judging whether the foreground object is in the dangerous region of the handrail entry, whether the target foreground object is about to enter the dangerous region of the handrail entry is pre-judged based on the movement track of the target foreground object, and it is determined that the handrail entry is in the abnormal state when the judgment result is "yes".

16. The handrail entry monitoring method of claim 14, wherein, in the step of generating a movement track, a same foreground target in the multiple continuous data frames is tracked by using a Bayesian filter technology, and the movement track is generated by using position features of the same foreground target extracted by the foreground feature extraction module from the multiple continuous data frames respectively.

17. The handrail entry monitoring method of claim 13, wherein the analyzing step further comprises: defining, based on the data frame sensed when the handrail entry of the passenger conveyor is in the normal state, the monitored dangerous region.

18. The handrail entry monitoring method of claim 13, wherein, in the step of obtaining a foreground object, the foreground object is filtered.

19. The handrail entry monitoring method of claim 13, wherein, in the extracting step, a foreground object, an object texture, and one or more of a shape feature, a color feature, a size feature, a scale invariant feature transform feature, a corner feature, and a principal component feature are further extracted; and the analyzing step further comprises: judging, based on the foreground object, the object texture, and one or more of the shape feature, the color feature, the size feature, the scale invariant feature transform feature, the corner feature, and the principal component feature, whether the foreground object is a foreign matter that needs to completely avoid being entrapped.

20. The handrail entry monitoring method of claim 13, wherein the background model is established by using a Gaussian mixture model, code book model learning, principle components analysis, robust principle components analysis, mean filtering, neural network methods, kernel density estimation, adaptive kernel density estimation, recursive modeling or support vector data description modeling.

21. The handrail entry monitoring method of claim 13, wherein the analyzing step further comprises: directly determining that the handrail entry is in the normal state when the foreground object is basically absent.

22. The handrail entry monitoring method of claim 13, wherein an alarm unit is triggered to operate when it is determined that the handrail entry is in the abnormal state.

23. The handrail entry monitoring method of claim 13, wherein an output signal is triggered to enable a braking part of the passenger conveyor to operate when it is determined that the handrail entry is in the abnormal state.

* * * * *